US011008147B2

(12) United States Patent
Glinert et al.

(10) Patent No.: US 11,008,147 B2
(45) Date of Patent: May 18, 2021

(54) SECURITY PACKAGING

(71) Applicant: Multi Packaging Solutions, Inc., Lansing, MI (US)

(72) Inventors: Ken Glinert, Chappaqua, NY (US); Eric Rosendall, Grand Ledge, MI (US); Richard C. Thibault, Westchester, PA (US); Nick Lakin, Greenwood, IN (US)

(73) Assignee: MULTI PACKAGING SOLUTIONS, INC., Lansing, MI (US)

( * ) Notice: Subject to any disclaimer, the term of this patent is extended or adjusted under 35 U.S.C. 154(b) by 5 days.

(21) Appl. No.: 16/401,262

(22) Filed: May 2, 2019

(65) Prior Publication Data

US 2019/0256272 A1 Aug. 22, 2019

Related U.S. Application Data

(63) Continuation of application No. 15/241,386, filed on Aug. 19, 2016, now Pat. No. 10,329,067.
(Continued)

(51) Int. Cl.
*B65D 79/00* (2006.01)
*B65D 73/00* (2006.01)
(Continued)

(52) U.S. Cl.
CPC ..... *B65D 79/00* (2013.01); *B65D 73/0007* (2013.01); *B65D 73/0028* (2013.01);
(Continued)

(58) Field of Classification Search
CPC ..... B65D 79/00; B65D 73/0007; B65D 73/0028; B65D 73/0042; B65D 73/0085;
(Continued)

(56) References Cited

U.S. PATENT DOCUMENTS 4,726,473 A 2/1988 Sato et al.
5,609,253 A 3/1997 Goade, Sr.
(Continued)

FOREIGN PATENT DOCUMENTS

CA 2627782 A1 9/2008
EP 1296306 A2 3/2003
(Continued)

OTHER PUBLICATIONS

European Extended Search Report dated Mar. 1, 2017; Application No. 16185054.0.
(Continued)

*Primary Examiner* — Rafael A Ortiz
(74) *Attorney, Agent, or Firm* — The Dobrusin Law Firm, P.C.; Bryan S. Lemanski

(57) ABSTRACT

A security packaging provides a structure for providing evidence of package tampering. The packaging includes a first panel having an opening, and a foil label at least partially overlaying the opening and at least partially adhered to an insert member. Upon separation of the insert member from the packaging, at least a portion of the foil label is separated from the foil label thereby leaving a visual void in the opening indicating that the separation has occurred.

13 Claims, 5 Drawing Sheets

Related U.S. Application Data

(60) Provisional application No. 62/207,939, filed on Aug. 21, 2015.

(51) Int. Cl.
*B65D 75/22* (2006.01)
*B65D 75/56* (2006.01)
*B65D 75/58* (2006.01)

(52) U.S. Cl.
CPC ..... *B65D 73/0042* (2013.01); *B65D 73/0085* (2013.01); *B65D 75/22* (2013.01); *B65D 75/566* (2013.01); *B65D 75/5844* (2013.01); *B65D 2203/02* (2013.01); *B65D 2203/10* (2013.01); *B65D 2401/00* (2020.05); *B65D 2401/45* (2020.05)

(58) Field of Classification Search
CPC ..... B65D 75/22; B65D 75/566; B65D 2203/10; B65D 85/00; B65D 75/5844; B65D 2401/00; B65D 2401/45
USPC ..... 206/459.1, 460, 807, 39.7, 475, 472; 229/307
See application file for complete search history.

(56) References Cited

U.S. PATENT DOCUMENTS

| | | | | |
|---|---|---|---|---|
| 5,667,247 | A | 9/1997 | Ramsburg et al. | |
| 5,760,381 | A | 6/1998 | Stich et al. | |
| 5,777,305 | A | 7/1998 | Smith et al. | |
| 5,975,302 | A * | 11/1999 | Young | G09F 3/20 206/39 |
| 6,109,439 | A | 8/2000 | Goade, Sr. | |
| 6,269,158 | B1 * | 7/2001 | Kim | H04M 17/026 229/92.8 |
| 6,349,827 | B1 | 2/2002 | Feder | |
| 6,688,649 | B2 * | 2/2004 | Casagrande | G09F 3/0288 206/449 |
| 6,715,795 | B2 | 4/2004 | Klure | |
| 7,000,844 | B1 | 2/2006 | Smith | |
| 7,290,703 | B2 * | 11/2007 | Jacobs | G06Q 20/229 235/380 |
| 7,607,574 | B2 * | 10/2009 | Kingsborough | G06K 19/06018 235/375 |
| 7,753,262 | B2 | 7/2010 | Kingsborough et al. | |
| 8,109,388 | B2 | 2/2012 | Rosendall et al. | |
| 8,443,972 | B1 | 5/2013 | Pendergraph et al. | |
| 8,622,434 | B1 * | 1/2014 | Warther | B42D 15/045 283/82 |
| 8,632,006 | B2 | 1/2014 | Kingsborough et al. | |
| 8,800,758 | B2 * | 8/2014 | Roberts | G09F 1/00 206/39.7 |
| 2003/0150919 | A1 * | 8/2003 | Blank | B42D 15/0073 235/487 |
| 2004/0245134 | A1 | 12/2004 | Alcouloumre et al. | |
| 2005/0279825 | A1 | 12/2005 | Ashby et al. | |
| 2008/0237317 | A1 * | 10/2008 | Rosendall | B65D 73/0042 229/102 |
| 2009/0107862 | A1 | 4/2009 | Pascua et al. | |
| 2010/0213092 | A1 | 8/2010 | Swain | |
| 2011/0031148 | A1 * | 2/2011 | Rosendall | B65D 73/0078 206/459.1 |
| 2016/0031624 | A1 | 2/2016 | Pascua et al. | |

FOREIGN PATENT DOCUMENTS

| | | | |
|---|---|---|---|
| EP | 3372523 | A1 | 9/2018 |
| GB | 1372980 | A | 11/1974 |
| WO | 2011/016877 | A1 | 2/2011 |

OTHER PUBLICATIONS

Extended European Search Report and European Search Opinion dated. Aug. 16, 2018 for European Patent Application 18165751.1.
Co-pending European Application No. 18165751.1, filed on Apr. 4, 2018, published as EP 3372523.
Co-pending International Application No. PCT/U520101027770, filed on Mar. 18, 2010, published with International Search Report as WO2011/016877A1 on Feb. 10, 2011.
Co-pending U.S. Appl. No. 12/054,583, filed Mar. 25, 2008, published as US-2008-0237317-A1 on Oct. 2, 2008 (now abandoned).
Office Action dated Mar. 5, 2009 in co-pending U.S. Appl. No. 12/054,583, filed Mar. 25, 2008, published as US-2008-0237317-A1 on Oct. 2, 2008 (now abandoned).
Co-pending Canadian Application No. 2627782-Al, filed on Mar. 25, 2008.
Co-pending U.S. Appl. No. 12/132,363, filed Jun. 2, 2011.
Canadian Office Action dated Dec. 23, 2013; Application No. 2627782.
European Office Action for European Application 18165751.1; dated Jun. 27, 2019.

* cited by examiner

SECURITY PACKAGING

FIELD

The present teachings relate generally to tamper evident packaging, and more specifically to a security packaging which provides a visual indication if package tampering has occurred.

BACKGROUND

In the retail sector and elsewhere, as retail fraud and other criminal acts continue to be practiced, there has been an ongoing and growing need for improved tamper evident packaging. Foods, consumer products, medications, mail and other goods continue to be the object of tampering, whether to taint contents, alter freshness assurances, to gain valuable private and/or confidential information, or for some other purpose. In particular, product packaging is often damaged or compromised. One type of packaging that is particularly susceptible to tampering is that associated with pre-paid gift cards. As an example, it is a common practice in the pre-paid card sector to encode or otherwise load a card (e.g., a generally rectangular plastic "wallet-sized" card, akin to a credit card) with a predetermined cash equivalent value. Upon payment by a consumer for the value on the card, the card can then be used to pay for transactions until the value on the card has been depleted. The cards may not necessarily be registered in the identity of a particular individual, and thus resemble cash, in the sense that it is difficult to trace transactions and correlate them with particular users of the cards. The relative anonymity of the resulting transactions thus makes pre-paid cards attractive theft targets.

Security features are thus often employed in the packaging industry in an effort to deter theft and protect legitimate consumers. Unfortunately, many existing security features have been circumvented by individuals involved in retail theft. While many tamper-evident and theft-proof features have been developed, most are cost prohibitive given the low cost requirement for packaging, as the packaging must be provided to a consumer for essentially no cost as an enticement to seek goods or services from a particular retailer or service provider. In regard to pre-paid card packaging, assuming that a consumer is going to purchase a card with a value of $25, the consumer will only expect to pay $25 for the card, with no additional charges. As a result, it has proven particularly challenging to develop security features that effectively prevent and deter theft at a very low cost point.

A common theft issue with particular relevance to the pre-paid card industry includes the ability to remove a pre-paid card from a retail store without activating or purchasing the card. The account information can then be accessed and recorded and the card repackaged either in its original packaging or new packaging which can then be placed back onto a retail store shelf. Once the card is activated by a legitimate paying customer, the account information can be used to make purchases without the knowledge of the paying customer. For example, a wrongdoer may have taken a pre-paid card from a retail location, removed the card from its packaging, obtained the code associated with the card, and then carefully re-packaged the card so it appears unused, as if new. The wrongdoer will then enter into a transaction (e.g., on the internet, via mail order, or otherwise) in which the wrongdoer supplies the card code as means of payment. If and when the card is activated by the legitimate user, the transaction of the wrongdoer will be processed. The sophistication of the techniques of the wrongdoers has become so refined in recent years that re-packaging of cards into their original packaging commonly results in little or no evidence to a reasonably observant salesperson that the card has been removed from the packing and subsequently repackaged.

U.S. Pat. No. 5,777,305 discloses a packaging assembly that permits remote activation and deactivation of a pre-paid card without removing the card from the packaging. However, the teachings do not appear to address the difficulties in preventing an individual from stealing an un-activated card, removing the un-activated card from the packaging to record any necessary account numbers or codes from the card and placing the un-activated card back into the packaging and subsequently back on a store shelf.

U.S. Pat. No. 5,667,247 discloses a card package assembly that includes an adhesive placed on an inner wall of the packaging to hold a card in place. However, the packaging does not appear to afford a simple and straightforward approach to determining whether tampering has occurred.

U.S. Pat. No. 7,000,844 discloses a display packaging for gift cards that includes a personal identification number or "PIN" obscured by a removable covering. However, one of the problems sought to be addressed by the present teachings does not appear to be solved by teachings of that patent, inasmuch as the disclosure of the patent makes it possible to re-cover the PIN to create the appearance that no tampering has occurred.

U.S. Patent Application Publication No. 2009/0107862 discloses a card and carrier system that shows damage to the carrier when the enclosed card is accessed. However, the card itself shows no indication of tampering and there is no means disclosed to prevent the carrier from being repaired with no indication of tampering.

Notwithstanding the above, there remains a need for improved packaging that indicates tampering on a carrier so that the carrier cannot be repaired or reproduced with no tamper indication. There is a further need for packaging that includes unique patterns and associated substrates so that the packaging cannot be easily recreated. More particularly, there continues to be a need for low-cost tamper-evident packaging that does not allow individuals to re-package a pre-paid card after accessing and recording the necessary account information from the pre-paid card.

SUMMARY

The present teachings address one or more of the above needs by providing an improved tamper evident packaging and associated methods in which the packaging protects an insert member in a manner in which the insert member cannot be removed without substantially, irreversibly disrupting at least one visual indicator.

For example, the packaging may include at least one panel, an insert member sufficiently adhered to at least one of the panels or sufficiently contained between at least two panels, and an opening that is at least partially covered by a foil label. The foil label may be at least partially adhered to a first portion of the insert member. When the insert member is separated or removed from the packaging, at least a portion of the foil label remains adhered to the insert member thus forming a visible void in the foil label. The visible void in the foil label may be substantially irreversible so that before a legitimate or actual sale and/or activation, the void may provide a visual and/or tactile indication to a customer and/or salesperson of possible tampering of the packaging and/or a compromised insert member. The portion of the foil label may remain adhered to a portion of the insert member that may contain specific information required for activating the insert member, and/or making a purchase. However, removing the foil label from the insert member may be substantially irreversible so that if the insert member is placed back into the packaging after the foil label is removed from the insert member, another void may be visible to a customer and/or salesperson suggesting possible tampering of the packaging and/or a compromised insert member.

For example, at least one of the panels may include a tear-off strip. At least partially removing the tear-off strip may provide visual access to a portion of the insert member that may be required for activating the insert member, for example. However, at least partially removing the tear-off strip may be substantially irreversible, which may provide a visual and/or tactile indication to a customer and/or salesperson of possible tampering of the packaging and/or a compromised insert member.

For example, at least one of the panels may include a tear-off window for accessing the insert member and for removing the insert member from the packaging. At least partially removing the tear-off window may be substantially irreversible, which may provide a visual and/or tactile indication to a customer and/or salesperson of possible tampering of the packaging and/or a compromised insert member.

For example, at least one of the panels may include a loss prevention feature or tag. The loss prevention feature or tag may prevent or at least deter theft by sounding an alarm if the packaging is removed from a retail store before the loss prevention feature or tag is deactivated.

For example, the insert member may comprise an activation portion and a redemption portion. A security code may be provided across both portions of the insert member. The security code may be required to activate the insert member, for example. Separating the activation portion from the redemption portion, or vice versa, may cause the security code to separate, thereby making the security code inoperable. The separation of the activation portion may be substantially irreversible, thus providing a visual and/or tactile indication to a customer and/or salesperson of possible tampering and/or a compromised insert member.

For example, the packaging may include two panels, which may be formed from polyvinyl chloride (PVC). The panels may be "welded' together with a sufficient polyurethane (PUR) adhesive.

DETAILED DESCRIPTION

Figure 1A:
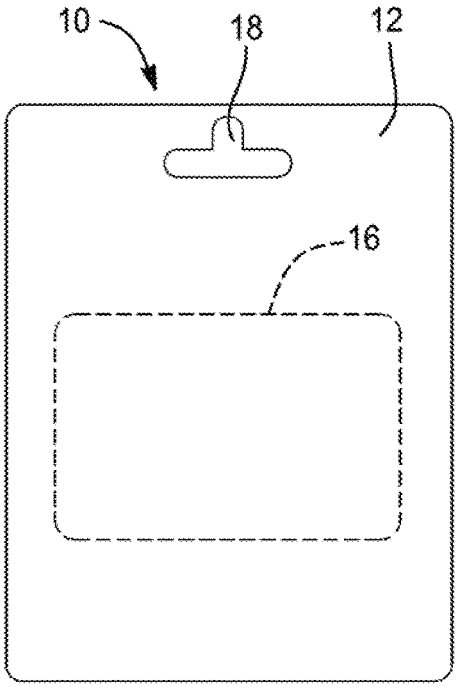
FIG. 1A illustrates a front view of the packaging.

The explanations and illustrations presented herein are intended to acquaint others skilled in the art with the teachings, its principles, and its practical application. Those skilled in the art may adapt and apply the teachings in its numerous forms, as may be best suited to the requirements of a particular use. Accordingly, the specific embodiments of the present teachings as set forth are not intended as being exhaustive or limiting of the teachings. The scope of the teachings should, therefore, be determined not with reference to the above description, but should instead be determined with reference to the appended claims, along with the full scope of equivalents to which such claims are entitled. The disclosures of all articles and references, including patent applications and publications, are incorporated by reference for all purposes. Other combinations are also possible as will be gleaned from the following claims, which are also hereby incorporated by reference into this written description.

The packaging according to the teachings herein may support, house, contain, and/or protect one or more articles, such as one or more insert members, for example. Preferably, the packaging can be used to prevent, or at least deter, theft, tampering, and/or compromise of the article or insert member. The packaging may include one or more features, and/or may be formed by one or more of the method steps included in commonly owned patent application Ser. No. 12/726,521 filed on Mar. 18, 2010, now U.S. Pat. No. 8,109,388 the disclosure of which is hereby incorporated by reference in its entirety.

The packaging may include one or more panels. The panels discussed herein may be any packaging material pliable enough to be scored and folded but strong enough to provide sufficient support for containing an article or member thereon or within. A particular feature of the material may be that it is durable enough to resist tearing during attempts to remove any packaging contents from the panel and/or within a pair of panels. The panels may be formed of paper materials including but not limited to paperboard, chipboard, cardboard, fiberboard, natural fibers, mineral fibers or any combination thereof. The panel material may be a virgin material, a post-consumer recycled material, or both. The panel material may be a recyclable material and/or a biodegradable material. If the panel material includes paperboard, the paperboard may be a bleached or unbleached paperboard. For example, it may be a solid bleached sulfate (SBS) paperboard. The panel material may contain a major portion that can be recycled. The panels may be formed of a polymeric material including but not limited to thermoplastics, thermoset plastics, elastomeric containing materials or any combination thereof. Examples of polymeric materials that may be employed include polyamide, polyester, polystyrene, polyethylene (including polyethylene terephthlate, high density polyethylene and low density polyethylene), polypropylene, polyvinyl chloride, bio-based plastics/biopolymers (e.g., poly lactic acid), silicone, acrylonitrile butadiene styrene (ABS), or any combination thereof. The gauge of the panel material may vary depending on the size of the packaging or the desired strength of the packaging. As an example, if the panel material includes paperboard, the gauge of the paperboard may be greater than about 6 point paperboard. The gauge of the paperboard may be less than about 22 point paperboard.

At least one of the panels may include an opening. The opening may be suitable for receiving a shelf or rack rod and hanging the packaging from a display rack in a retail store, for example. The opening may be any shape. Preferably, the opening is a "sombrero" shaped aperture, for example.

At least one of the panels may include one or more cut-out openings. The cut-out opening may be any opening that is at least partially covered by a foil label. The cut-out opening can be any suitable size and/or shape. For example, the cut out opening can be a square, rectangle, circle, oval, etc. The foil label may be at least partially attached, secured, and/or adhered to a portion of the insert member, so that when the insert member is removed from the packaging, at least a portion of the foil label is removed with the insert member. That is, when the insert member is removed or separated from the one or more panels or packaging, at least the portion of the foil label that is attached or adhered to the insert member is torn or otherwise separated form the foil label, which may thus result in a substantially irreversible void in the foil label, the packaging, or both. For example, the void may be a rip, tear, slit, and/or opening. Substantially irreversible as used herein may mean that the void cannot be repaired or reconstructed in a sufficient manor that is unnoticeable to an alert customer and/or sales person, for example. Accordingly, the void in the foil member may provide a visual and/or tactile indicator to a customer and/or salesperson of possible tampering of the packaging and/or a compromised insert member.

The foil label may be formed from any suitable material. For example, the foil label can a holographic foil so that the foil label is difficult to repair and/or reconstruct after damage by separation of the foil label from the packaging, the insert member, or both. The foil label may include a pattern layer as disclosed in commonly owned patent application Ser. No. 12/726,521 filed on Mar. 18, 2010, now U.S. Pat. No. 8,109,388. The foil label may include graphics, design, and/or words, for example. The foil label may be embossed, which may advantageously make it more difficult to reconstruct after separation from the packing, the insert member, or both. The foil label may be in black color so that damage is easier recognized. The foil label may include a polymeric material. Examples of such the foil material may include polyethylene terephthalate, nylon, polyvinyl chloride, polypropylene, high-density polyethylene, low-density polyethylene, linear low-density polyethylene, polyvinylidene chloride and combinations thereof. The foil label may be attached or sufficiency adhered to the packaging, the insert member, or both. Preferably, the foil label is adhered with an adhesive to one or both of the panels, the insert member, or both.

Preferably, the adhesive includes one or more synthetic adhesives such as polymeric (e.g., thermoplastic, elastomeric, emulsion or thermosetting) adhesives. The adhesive may also include a bioadhesive such as starch, casein or albumin based adhesives. The adhesive may also include a UV curing adhesive. The adhesive may be a pressure sensitive adhesive. Preferably, the adhesive is a fugitive glue or adhesive.

At least one of the panels may include a tear-off strip. The tear-off strip may be a perforated or scored portion on one or both of the panels. The tear-off strip may be at least partially separated from the corresponding panel(s) so that at least partial access to the insert member is possible. Preferably, at least partially removing or separating the tear-off strip provides visual access to an activation window and/or a portion of the insert member. Preferably, at least partially removing or separating the tear-off strip provides visual access through an activation window in the corresponding panel to one or more identifiers on the insert member that may be required to activate, deactivate, use, and/or reload the insert member. For example, the one or more identifiers may include a card verification code (CVC) or other code(s) for performing a one-step or two-step activation as disclosed in U.S. Pat. No. 7,753,262, the disclosure of which is hereby incorporated by reference herein for all purposes. Preferably, at least partially removing or separating the tear-off strip is substantially irreversible. Substantially irreversible as used herein may mean that after the tear-off strip is removed or at least partially separated from the panel, the tear-off strip cannot be repaired or reconstructed in a sufficient manor that is unnoticeable to an alert customer and/or sales person, for example.

At least one of the panels may include a tear-off window. The tear-off window may be a perforated or scored portion on one or both of the panels. The tear-off window may be at least partially separated from the corresponding panel(s) so that at least partial access to the insert member is possible. Preferably, at least partially removing or separating the tear-off strip provides visual access to the insert member so that the insert member can be removed or separated from the packaging. Preferably, at least partially removing or separating the tear-off window provides visual access through an activation window in the corresponding panel to one or more insert member identifiers that may be used to activate, deactivate, use, and/or reload the insert member. For example, the one or more identifiers may include a card verification code (CVC) or any other code to perform a one-step or a two-step activation, for example. Preferably, at least partially removing or separating the tear-off window is substantially irreversible. Substantially irreversible may mean that after the tear-off window is removed or at least partially separated from the corresponding panel, the tear-off window cannot be repaired or reconstructed in a sufficient manor that is unnoticeable to an alert customer and/or sales person, for example.

At least one of the panels may include one or more recessed portions. The recessed portion may be an indentation, a pocket, a recess, an opening, or the like made in the panel(s) that can accept a loss prevention feature or tag. The recessed portion may be suitably sized so that the loss prevention feature or tag can be placed into the panel and then covered by an insert member. Preferably, after the loss prevention feature or tag is covered by the insert member, it is difficult to determine whether the panel and/or the packaging includes a loss prevention feature or tag. That is, preferably, the insert member may lay flat against a surface of the panel while the loss prevention feature or tag is securely contained in the recessed portion under the insert member. However, to reduce costs, not all packages may include a loss prevention feature or tag. For example, only every second, third, fourth, or even fifth package may contain a loss prevention feature or tag. In this regard, however, one or more of the panels may contain sufficient language warning that all packages contains a loss prevention feature or tag. Moreover, because the insert member is preferably attached or securely adhered to the panel, "peeking" behind the insert member to determine if a particular package includes a loss prevention feature or tag can be prevented.

The loss prevention feature or tag may be any feature or device that may function to prevent or deter theft of the package. For example, the loss prevention feature or tag may be a "Sensormatic" tag manufactured by Sensormatic Electronics Corporation, which is a subsidiary of Tyco International, or a "Checkpoint" tag manufactured by Checkpoint Systems. If a package containing a loss prevention feature or tag is improperly removed from a retail store, for example, the loss prevention feature or tag may prompt an alarm at the retail store to sound. The alarm may be audible, visual, silent, or a combination thereof. Preferably, the loss prevention feature or tag can be deactivated so that after a package and/or insert member is legitimately purchased, the alarm does not sound.

The insert member may be any item requiring packaging in a retail setting. For example, the insert member may be or may include one or more features described in U.S. Pat. No. 8,632,006, which is hereby incorporated by reference in its entirety. The insert member may include at least one generally planar surface. In the case of the pre-paid card example, the insert member may generally be a polymeric material as is common with pre-paid cards. The insert member may be composed of materials similar to those disclosed for use in the panels such as paperboard materials. The material of the insert member may be able to form a sufficient bond with any adhesive used within the adhesion layers so that the adhesive maintains the bond with the insert member while separating at least a portion of the film member (or any coating or additional material layer contained thereon) from the packaging. Further, the material of the insert member must respond to any release coating or adhesive deadener so that the portions of the film member that should remain in contact with the film member effectively do so. The insert member may be a planar retail item. As an example, the insert member may be pre-paid card such as a gift card, ATM card, phone card or the like.

A security code may be placed on the insert member. The security code may function to provide information for activating, deactivating, reloading, and/or otherwise using the insert member. Preferably, the security code can be printed directly onto the insert member. The security code can be printed directly on the insert member and, preferably, printed across the activation portion and the redemption portion. The security code can be a sticker placed directly onto the insert member, and, preferably, placed across the activation portion and the redemption portion. After the activation portion is separated from the redemption portion, or vice versa, the security code can be broken. The broken security code can be substantially irreversible. Substantially irreversible as used herein may mean that after the security code is broken, the security code cannot be repaired or reconstructed in a sufficient manor that is unnoticeable to an alert customer and/or sales person, for example.

Preferably, the security code can be broken so that a first portion of the code remains on the activation portion, and another portion remains on the redemption portion. Preferably, the security code can be broken along a diagonal line or axis. The security code can be broken along a diagonal line that is irregular thus making difficult reconstruction or repairs to the security code after breaking.

Figure 1B:
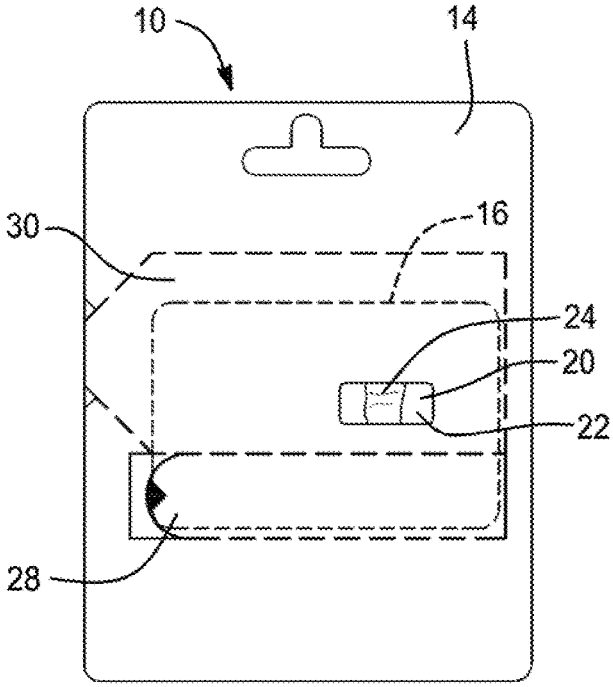
FIG. 1B illustrates a back view of the packaging.

As illustrated in FIGS. 1A and 1B, the packaging 10 includes two panels 12, 14. An insert member 16 is located between the panels 12, 14. The panels 12, 14 include an opening 18 suitable for receiving a shelf or rack rod and hanging the packaging 10 from a display rack in a retail store, for example. A cut-out window 20 is formed in the panel 14. A foil label 22 is secured or adhered to the panel 14 so that the cut-out window 20 is at least partially covered by the foil label 22. Preferably, at least a portion 24 of the foil label 22 is secured or adhered to at least a first portion 26 of the insert member 16 (See also FIG. 1D) with a suitable adhesive, such as fugitive glue. The first portion 26 of the insert member 16 may include a unique identifier, such as a card verification code (CVC), for example, that may be required to activate the insert member 16, complete a purchase or transaction, reload the insert member 16, etc. The panel 14 also includes a tear-off strip 28 and a tear-off window 30.

Figure 1C:
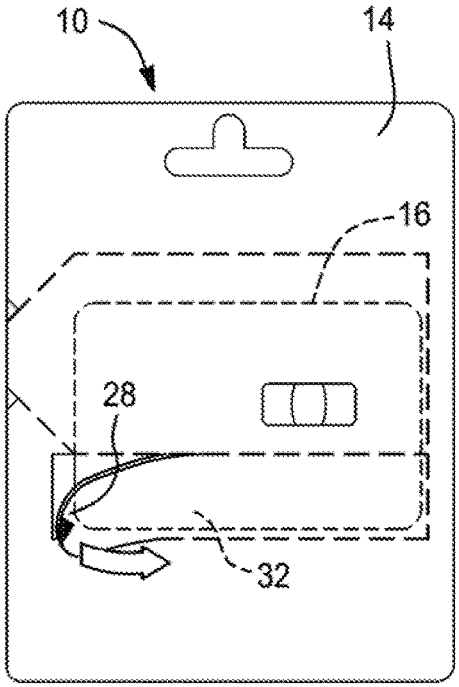
FIG. 1C illustrates a back view of the packaging.
Figure 1D:
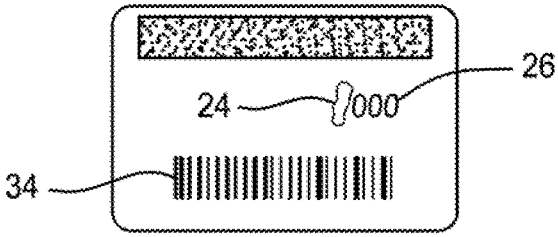
FIG. 1D illustrates a back view of the insert member.

With additional reference to FIGS. 1C and 1D, the tear-off strip 28 can be pulled or separated from the panel 14 to expose an activation window 32 in the panel 14. The activation window 32 is preferably aligned with a second portion 34 of the insert member 16. The second portion 34 of the insert member 16 may include sufficient information suitable for either activating the insert member, making or completing a transaction, reloading the insert member 16, etc. Preferably, pulling the tear-off strip 28 and exposing the activation window 32 is substantially irreversible. Accordingly, if the tear-off strip 28 is pulled or separated before a legitimate or actual sale and/or activation, the separated tear-off strip 28 provides a visual and/or tactile indicator to a customer and/or salesperson of possible tampering of the packaging 10 and/or a compromised insert member 16.

After the tear-off strip 28 is at least partially pulled, the insert member 16 can be removed from the packaging 10 by sliding the insert member 16 through the activation window 32. Alternatively, or additionally, the insert member 16 can be removed from the packaging 10 by at least partially pulling or removing the tear-off window 30 and removing the insert member 16 from the packaging 10. Preferably, pulling and/or removing the tear-off window 30 is also substantially irreversible so that before a legitimate or actual sale or activation, a pulled or removed tear-off window 30 may provide another visual and/or tactile indicator to a customer and/or salesperson of possible tampering of the packaging 10 and/or a compromised insert member 16.

Figure 1E:
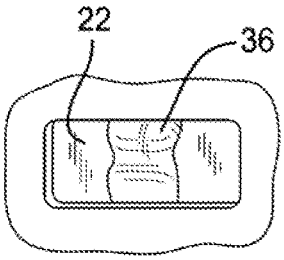
FIG. 1E illustrates a detailed view of the foil label after the insert member has been removed from the packaging.

After the insert member 16 is removed or separated from the packaging 10, at least the portion 24 of the foil label 22 that is adhered to the insert member 16 is separated from the foil label 22 thereby forming a visual rip or void 36 in the foil label 22. Preferably, the rip or void 36 is substantially irreversible, which, as illustrated in FIG. 1E, for example, provides yet another visual and/or tactile indicator to a customer and/or salesperson of possible tampering of the packaging 10 and/or a compromised insert member 16.

Preferably, after the insert member 16 is removed or separated from the packaging 10, the portion 24 of the foil label 22 remains adhered to the first portion 26 of the insert member 16. Accordingly, the first portion 26 of the insert member 16 remains covered by the foil label 22. To access the first portion 26 of the insert member 16 (i.e., to make a purchase, for example), the first portion 24 of the foil label 22 must be removed from insert member 16. However, preferably, removing the foil label 22 from the insert member 16 is substantially irreversible. In other words, removing the first portion 24 of the foil label 22 from the insert member 16 may cause the foil label 22 to fall apart, degrade, become damaged, etc. Accordingly, an attempt to place the insert member 16 back into the packaging 10 after removing the foil label 22 from the insert member 16 may provide yet another visual and/or tactile indicator to a customer and/or salesperson of possible tampering of the packaging 10 and/or a compromised insert member 16.

Figure 1F:
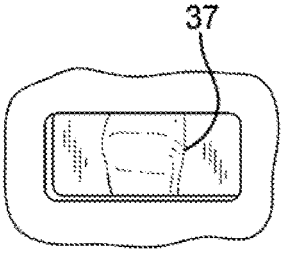
FIG. 1F illustrates a detailed view of the foil label after the insert member has been removed from the packaging and then placed back into the packaging.

Referring to FIG. 1F, if an attempt is made to place the insert member 16 back into the packaging 10 before the foil label 22 is removed from the insert member 16, a void 37 is formed. The void 37 may be a visible a tear or outline, for example. The void 37 may function as another visual and/or tactile indicator to a customer and/or salesperson of possible tampering of the packaging 10 and/or a compromised insert member 16.

Figure 2A:
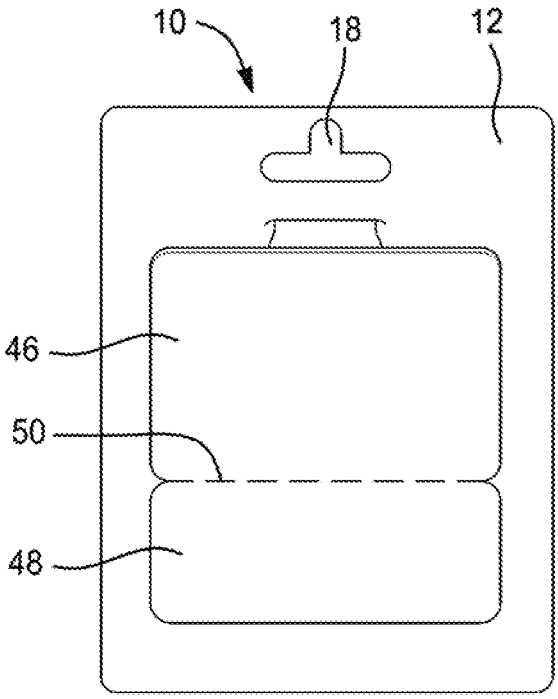
FIG. 2A illustrates a front view of the packaging and the insert member.
Figure 2B:
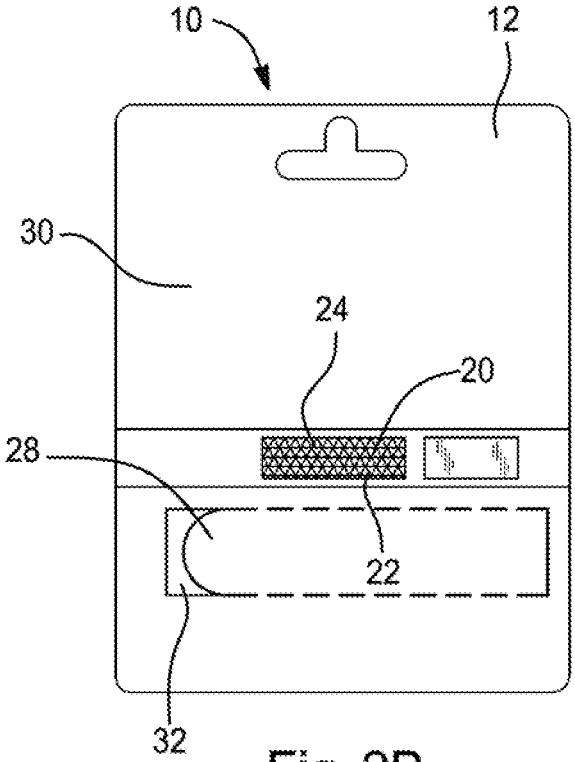
FIG. 2B illustrates a back view of the packaging.
Figure 2C:
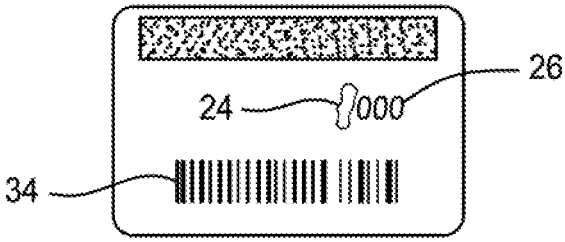
FIG. 2C illustrates a back view of the insert member.

As illustrated in FIGS. 2A-2C, the packaging 10 includes a panel 12. An insert member 16 is secured or otherwise adhered to the panel 12. Preferably, the insert member 16 is sufficiently secured or adhered to the panel 12 so that "peeking" or otherwise seeing behind the insert member 16 is sufficiently prevented. The insert member 16 comprises a redemption portion 46 and an activation portion 48. An interface 50 may be located between the portions 46, 48, which may be a score or break line in a "snap and break configuration", for example. The panel 12 may include an opening 18 suitable for receiving a shelf or rack rod and hanging the packaging 10 from a display rack in a retail store, for example.

A cut-out window 20 is formed in the panel 12. A foil label 22 is secured or adhered to the panel 12 so that the cut-out window 20 is at least partially covered. Preferably, at least a portion 24 of the foil label 22 is secured or adhered to at least a first portion 26 of the insert member 16 (See also FIG. 2C) with a suitable adhesive, such as fugitive glue. The first portion 26 of the insert member 16 may include a unique identifier, such as a CVC code, for example, that is preferably required to activate the insert member 16, complete a purchase or transaction, etc.

The panel 12 includes a tear-off strip 28. The tear-off strip 28 can be pulled or at least partially separated from the panel 12 to expose an activation window 32 in the panel 12. The activation window 32 may be aligned with a second portion 34 of the insert member 16. The second portion 34 of the insert member 16 may include sufficient information suitable for either activating the insert member, making a purchase, reloading the insert member 16, etc. Preferably, pulling the tear-off strip 28 and exposing the activation window 32 is substantially irreversible. Accordingly, after the tear-off strip 28 is pulled or at least partially separated from the panel, the pulled or separated tear-off strip 28 may provide a visual and/or tactile indicator to a customer and/or salesperson of possible tampering of the packaging 10 and/or a compromised insert member 16.

Figure 2D:
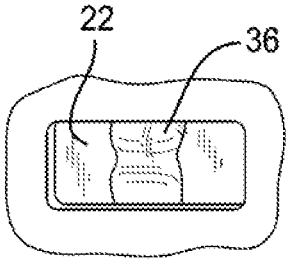
FIG. 2D illustrates a detailed view of the foil label after the insert member has been separated from the packaging.

After the insert member 16 is separated from the packaging 10, at least the portion 24 of the foil label 22 that is adhered to the insert member 16 is separated from the foil label 22. Thus, a visible rip or void 36 in the foil label 22 is formed. Preferably, the void 36 is substantially irreversible, which as illustrated in FIG. 2D, for example, may provide yet another visual and/or tactile indicator to a customer and/or salesperson of possible tampering of the packaging 10 and/or a compromised insert member 16.

Preferably, after the insert member 16 is removed from the packaging 10, the portion 24 of the foil label 22 that is adhered to the insert member 16 remains adhered to the first portion 26 of the insert member 16. To access the information on the insert member 16 that is covered by the foil label 22, (i.e., to make a purchase, to activate the insert member 16, etc.), the first portion 24 of the foil label 22 must be removed from insert member 16. Preferably, removing the foil label 22 from the insert member 16 is substantially irreversible. In other words, removing the first portion 24 of the foil label 22 from the insert member 16 may cause the foil label 22 to fall apart, degrade, become damaged, etc. Accordingly, an attempt to place the insert member 16 back into the packaging 10 after removing the foil label 22 from the insert member 16 may provide yet another visual and/or tactile indicator to a customer and/or salesperson of possible tampering of the packaging 10 and/or a compromised insert member 16.

Figure 2E:
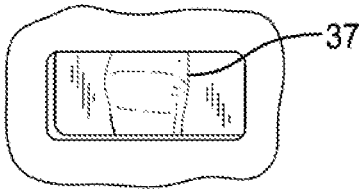
FIG. 2E illustrates a detailed view of the foil label after the insert member has been separated from the packaging and then placed back into the packaging.

Referring to FIG. 2E, if an attempt is made to secure or adhere the insert member 16 back onto the panel 12 and/or the packaging 10 after the insert member 16 is separated therefrom but before the foil label 22 is removed from the insert member 16, still yet another void 37 may be formed. The void 37 may function as another visual and/or tactile indicator to a customer and/or salesperson of possible tampering of the packaging 10 and/or a compromised insert member 16.

As illustrated in FIGS. 3A-3D, the packaging 10 includes a panel 12. An insert member 16 is secured or otherwise adhered to the panel 12. Preferably, the insert member 16 is sufficiently secured or adhered to the panel 12 so that "peeking" or otherwise seeing behind the insert member 16 is sufficiently prevented. The insert member 16 comprises a redemption portion 46 and an activation portion 48. An interface 50 may be located between the portions 46, 48, which may be a score or break line in a "snap and break configuration", for example. The panel 12 may include an opening 18 suitable for receiving a shelf or rack rod and hanging the packaging 10 from a display rack in a retail store, for example.

A cut-out window 20 is formed in the panel 12. A foil label 22 is secured or adhered to the panel 12 so that the cut-out window 20 is at least partially covered by the foil label 22. Preferably, at least a portion 24 of the foil label 22 is secured or adhered to at least a first portion 26 of the insert member 16 with a suitable adhesive, such as fugitive glue (See FIGS. 1D and 2C, for example). The first portion 26 of the insert member 16 may include a unique identifier, such as a card verification code (CVC), for example, that is preferably required to activate the insert member 16, complete a purchase or transaction, or both.

The panel 12 may include a tear-off strip 28. The tear-off strip 28 can be pulled to expose an activation window 32 in the panel 12. Preferably, the activation window 32 is aligned with a second portion 34 of the insert member 16 (See FIGS. 1D and 2C, for example). The second portion 34 of the insert member 16 may include sufficient information suitable for activation, making a purchase, or the like. Preferably, pulling the tear-off strip 28 and exposing the activation window 32 is substantially irreversible, which, may provide a visual and/or tactile indicator to a customer and/or salesperson before a legitimate or actual sale and/or activation of possible tampering of the packaging 10 and/or a compromised insert member 16.

The panel 12 may include a recessed portion 38. One or more anti-theft or loss prevention features 40 can be placed into the recessed portion 38. When the insert member 16 is secured or otherwise adhered to the panel 12, the insert member 16 preferably lay flat against the panel 12 thus hiding the loss prevention feature 40 behind the insert member 16.

Figure 3A:
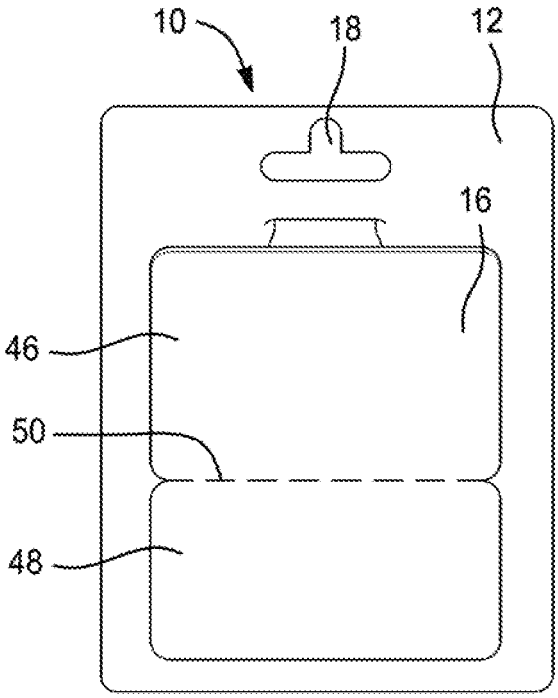
FIG. 3A illustrates a front view of the packaging including an insert member.
Figure 3B:
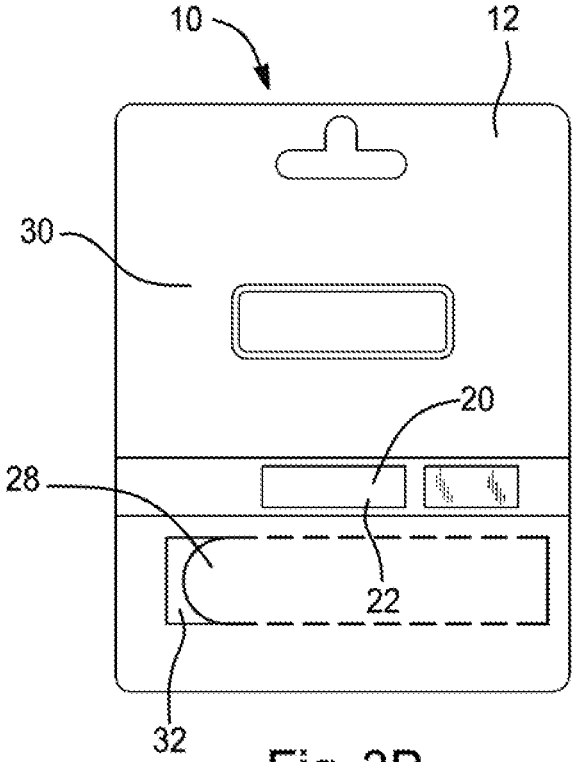
FIG. 3B illustrates a back view of the packaging.
Figure 3C:
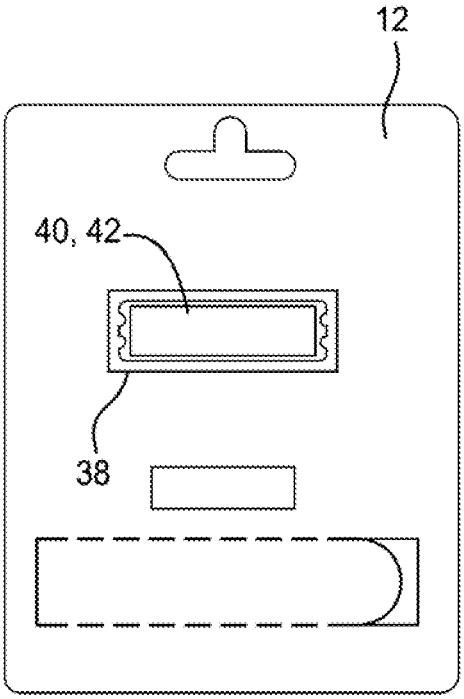
FIG. 3C illustrates a front view of the packaging including the loss prevention feature or tag.
Figure 3D:
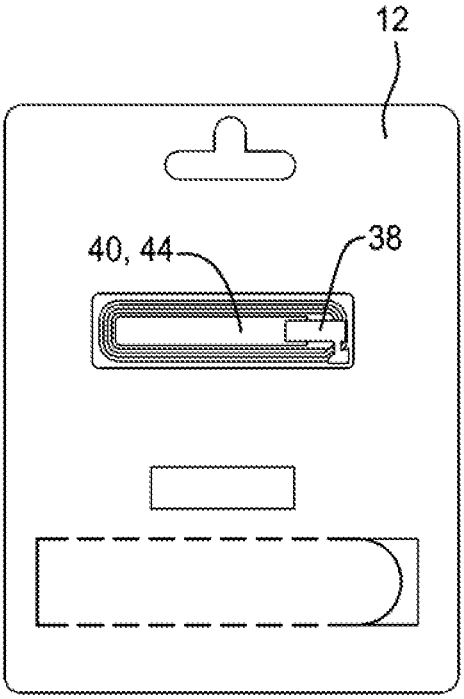
FIG. 3D illustrates a front view of the packaging including the loss prevention feature or tag.

The loss prevention feature 40 can be a "sensormatic" tag 42 (FIG. 3C) or a "checkpoint" tag 44 (FIG. 3D). If the package 10 is removed from a retail store without deactivating the loss prevention feature 40, a retail store alarm may be activated, for example. For reasons such as reducing cost, it may be preferred that not all packages 10 include a loss prevention feature 40. In other words, for example, every second, third, or even fourth package 10, may include a loss prevention feature 40. However, preferably, the package 10 and/or the panel 12 may include language suggesting that every package 10 includes a loss prevention feature 40. Moreover, because the insert member 16 is preferably secured or otherwise adhered to the panel 12 so that "peeking" or otherwise seeing behind the insert member 16 is sufficiently prevented, determining whether a particular package 10 does or does not include a loss prevention feature 40 may be cumbersome or prevented. Lifting or prying at least a portion of the insert member 16 away from the panel 12 may cause the insert member 16 to be separated therefrom. After the insert member 16 is separated from the packaging 10, at least the portion 24 of the foil label 22 adhered to the insert member 16 is separated from the foil label 22 thereby forming a visible rip or void 36 in the foil label 22. Preferably, the rip or void 36 is substantially irreversible, (See FIG. 2D, for example) and may provide yet another visual and/or tactile indicator to a customer and/or salesperson of possible tampering of the packaging 10 and/or a compromised insert member 16.

Preferably, after the insert member 16 is removed or separated from the packaging 10, the portion 24 of the foil label 22 remains attached or adhered to the first portion 26 of the insert member 16. Accordingly, the first portion 26 of the insert member 16 remains covered by the foil label 22 (See FIGS. 1D and/or 2C, for example). To access the first portion 26 of the insert member 16 (i.e., to make a purchase, or to activate the insert member 16 for example), the first portion 24 of the foil label 22 must be removed from insert member 16. Preferably, removing the foil label 22 from the insert member 16 is substantially irreversible. In other words, removing the first portion 24 of the foil label 22 from the insert member 16 may cause the foil label 22 to fall apart, degrade, become damaged, etc. Accordingly, an attempt to place the insert member 16 back into the packaging 10 after removing the foil label 22 from the insert member 16 may provide yet another visual and/or tactile indication to a customer and/or salesperson of possible tampering of the packaging 10 and/or a compromised insert member 16.

Figure 4A:
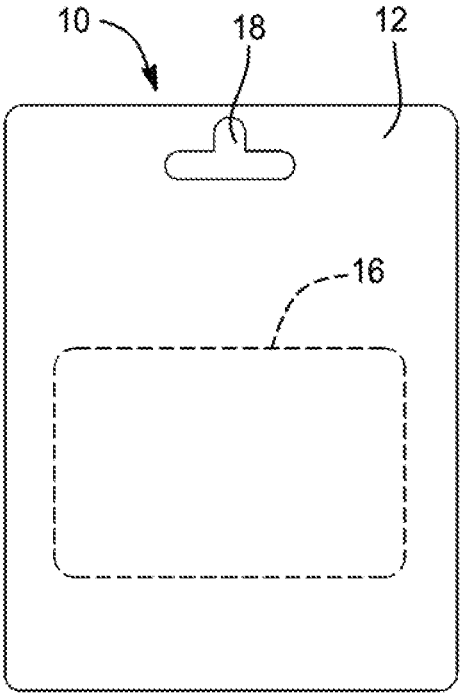
FIG. 4A illustrates a front view of the packaging.
Figure 4B:
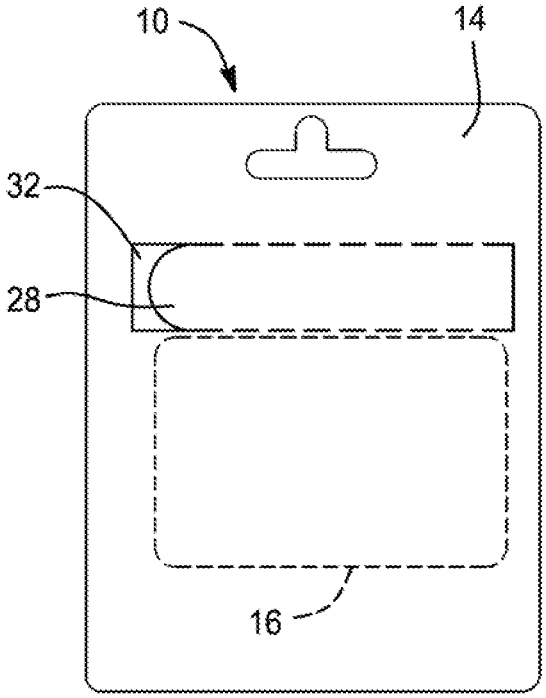
FIG. 4B illustrates a back view of the packaging.

As illustrated in FIGS. 4A and 4B, the packaging 10 may include two panels 12, 14. An insert member 16 may be located between the panels 12, 14. The panels 12, 14 may include an opening 18 suitable for receiving a shelf or rack rod and hanging the packaging 10 from a display rack in a retail store, for example. Preferably, one or both of the panels 12, 14 are formed from polyvinyl chloride (PVC). Preferably, the panels 12, 14 are at least partly secured, bonded, or "welded' together with a sufficient polyurethane (PUR) adhesive. Accordingly, separation of the panels 12, 14 with a knife, for example, may be cumbersome or even impossible without visually damaging the packaging 10. Accordingly, a damaged packaging 10 before an actual sale and/or legitimate activation of the insert member 16 may provide a visual and/or tactile indicator to a customer and/or salesperson of possible tampering of the packaging 10 and/or a compromised insert member 16.

The panel 14 may include a tear-off strip 28. The tear-off strip 28 can be pulled to expose an activation window 32 in the panel 14. Preferably, the activation window 32 is aligned with a second portion 34 of the insert member 16. The second portion 34 of the insert member 16 may include sufficient information suitable for making a purchase, activating the insert member, or the like, for example. After the tear-off strip 28 is at least partially pulled, the insert member 16 can be removed from the packaging 10 by sliding the insert member 16 through the activation window 32. Preferably, pulling the tear-off strip 28 and exposing the activation window 32 is substantially irreversible, which before a legitimate or actual sale and/or activation, may provide a visual and/or tactile indication to a customer and/or salesperson of possible tampering of the packaging 10 and/or a compromised insert member 16.

Figure 5A:
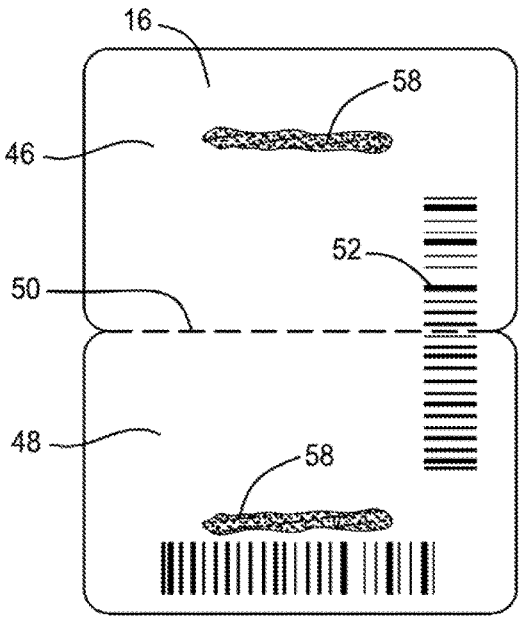
FIG. 5A illustrates a perspective view of the insert member including a security code.
Figure 5B:
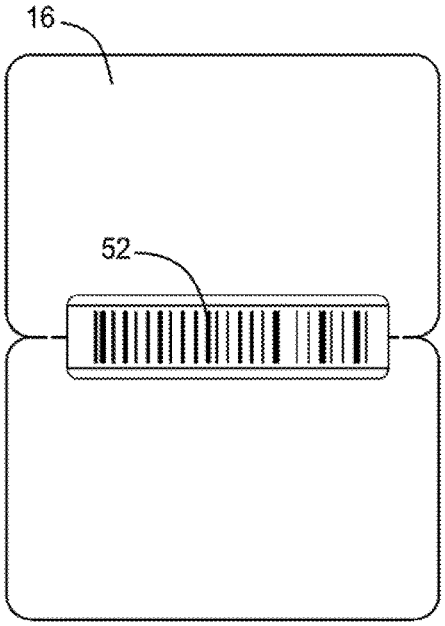
FIG. 5B illustrates a perspective view of the insert member including a security code.
Figure 5C:
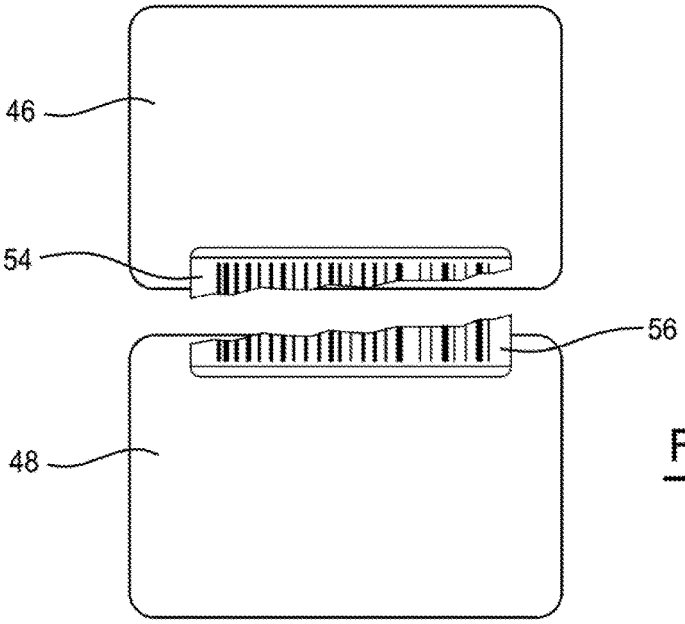
FIG. 5C illustrates a perspective view of a separated insert member and security code.

As illustrated in FIGS. 5A-5C, an insert member 16 may be secured or otherwise adhered to the panel 12 (See FIGS. 2A-2B, 3A-3D). Preferably, the insert member 16 is sufficiently secured or adhered to the panel 12 with an adhesive 58 so that "peeking" or otherwise seeing behind the insert member 16, or a portion of the panel 12 behind the insert member 16, is sufficiently prevented.

The panel 12 may include one or more of the features described above, including: an opening 18 for hanging the packaging 10 from a display rack in a retail store; a cut-out window 20 at least partially covered by a foil label 22 that is at least partially secured or adhered to at least a first portion 26 of the insert member 16 with a suitable adhesive; and/or a tear-off strip 28 configured to be pulled to expose an activation window 32 in the panel 12.

The insert member 16 comprises a redemption portion 46 and an activation portion 48. An interface 50 may be located between the portions 46, 48, which may be a score or break line in a "snap and break" configuration, for example. The insert member 16 may include a security code 52 spanning both portions 46, 48 of the insert member 16 and the interface 50. The security code 52 may be printed directly on the insert member 16 (FIG. 5A) or may comprise a sticker attached to the insert member 16 (FIGS. 5B-5C).

After the redemption portion 46 and the activation portion 48 are separated, the security code 52 may be broken or separated such that a portion 54 of the security code 52 remains on the redemption portion 46, and another portion 56 of the security code 52 remains on the activation portion 48. In some configurations, separation of the portions 46, 48 may provide for the security code 52 to be separated along a longitudinal axis generally parallel to an edge of the insert member 16. Preferably, however, the security code 52 is separated along a unique, diagonal and/or irregular line or axis. Accordingly, after the security code 52 is separated, each portion 54, 56 is preferably inoperable by itself to scan, use, and/or activate the insert member 16 and/or the redemption portion 46.

Any numerical values recited herein include all values from the lower value to the upper value in increments of one unit provided that there is a separation of at least 2 units between any lower value and any higher value. As an example, if it is stated that the amount of a component or a value of a process variable such as, for example, temperature, pressure, time and the like is, for example, from 1 to 90, preferably from 20 to 80, more preferably from 30 to 70, it is intended that values such as 15 to 85, 22 to 68, 43 to 51, 30 to 32 etc. are expressly enumerated in this specification. For values which are less than one, one unit is considered to be 0.0001, 0.001, 0.01 or 0.1 as appropriate. These are only examples of what is specifically intended and all possible combinations of numerical values between the lowest value and the highest value enumerated are to be considered to be expressly stated in this application in a similar manner. As can be seen, the teaching of amounts expressed as "parts by weight" herein also contemplates the same ranges expressed in terms of percent by weight. Thus, an expression in the Detailed Description of the Teachings of a range in terms of at "'x' parts by weight of the resulting polymeric blend composition" also contemplates a teaching of ranges of same recited amount of "x" in percent by weight of the resulting polymeric blend composition."

Unless otherwise stated, all ranges include both endpoints and all numbers between the endpoints. The use of "about" or "approximately" in connection with a range applies to both ends of the range. Thus, "about 20 to 30" is intended to cover "about 20 to about 30", inclusive of at least the specified endpoints.

The disclosures of all articles and references, including patent applications and publications, are incorporated by reference for all purposes. The term "consisting essentially of" to describe a combination shall include the elements, ingredients, components or steps identified, and such other elements ingredients, components or steps that do not materially affect the basic and novel characteristics of the combination. The use of the terms "comprising" or "including" to describe combinations of elements, ingredients, components or steps herein also contemplates embodiments that consist essentially of the elements, ingredients, components or steps.

Plural elements, ingredients, components or steps can be provided by a single integrated element, ingredient, component or step. Alternatively, a single integrated element, ingredient, component or step might be divided into separate plural elements, ingredients, components or steps. The disclosure of "a" or "one" to describe an element, ingredient, component or step is not intended to foreclose additional elements, ingredients, components or steps.

It is understood that the above description is intended to be illustrative and not restrictive. Many embodiments as well as many applications besides the examples provided will be apparent to those of skill in the art upon reading the above description. The scope of the teachings should, therefore, be determined not with reference to the above description, but should instead be determined with reference to the appended claims, along with the full scope of equivalents to which such claims are entitled. The disclosures of all articles and references, including patent applications and publications, are incorporated by reference for all purposes. The omission in the following claims of any aspect of subject matter that is disclosed herein is not a disclaimer of such subject matter, nor should it be regarded that the inventors did not consider such subject matter to be part of the disclosed inventive subject matter.

LISTING OF REFERENCE NUMERALS

10 packaging
12 panel
14 panel
16 insert Member
18 opening
20 cut out window
22 foil label
24 portion of foil label 22
26 first portion of insert member 16
28 tear-off strip
30 tear-off window
32 activation window
34 second portion
36 void in foil label 22
37 void
38 recessed portion
40 loss prevention feature or tag
42 sensormatic
44 checkpoint
46 activation portion
48 redemption portion
50 interface
52 security code
54 portion of security code 52
56 portion of security code 52
58 adhesive

We claim:

1. A plurality of packaging, each of the packaging comprising:

a panel having a tear-off strip and an activation window, wherein the tear-off strip and the activation window share a perforated edge;

an insert member disposed on the panel; and a recessed portion within the panel covered and hidden by the insert member;

wherein only a portion of the plurality of packaging further include a loss prevention feature located within the recessed portion.

2. The plurality of packaging of claim 1, wherein each of the packaging includes a cutout window and a foil label, the cutout window is located in the panel, and the foil label at least partially covers the cutout window.

3. The plurality of packaging of claim 2, wherein the activation window is larger in size than the tear-off strip.

4. The plurality of packaging of claim 3, wherein the insert member is removable from the packaging by removing the insert member from the tear-off strip, the panel, or both.

5. The packaging according to claim 2, wherein the foil label is adhered to the insert member.

6. The plurality of packaging according to claim 1, wherein the loss prevention feature is a sensormatic tag.

7. The plurality of packaging according to claim 1, wherein the loss prevention feature is a checkpoint tag.

8. A packaging, comprising a panel;

an insert member at least partially adhered to the panel, the insert member comprising an activation portion and a redemption portion, wherein a security code at least partially spans both of the activation portion and the redemption portion; and a recessed portion within the panel covered and hidden by the insert member, wherein a loss prevention feature is located within the recessed portion;

wherein upon separating the activation portion and the redemption portion, the security code is broken along a non-linear line.

9. The packaging of claim 8, wherein the security code is printed directly onto both of the activation portion and the redemption portion.

10. The packaging of claim 8, wherein the security code is a sticker that is adhered to both of the activation portion and the redemption portion.

11. The packaging of claim 8, wherein after separating the activation portion and the redemption portion, a portion of the security code extends beyond an edge of the activation portion or a portion of the security code extends beyond an edge of the redemption portion.

12. The packaging of claim 8, wherein after separating the activation portion and the redemption portion, a portion of the security code extends beyond an edge of the activation portion and a portion of the security code extends beyond an edge of the redemption portion.

13. The packaging of claim 10, wherein after separating the activation portion and the redemption portion, an edge of the sticker extends beyond an edge of the activation portion or an edge of the sticker extends beyond an edge of the redemption portion.

* * * * *